US007587304B2

(12) United States Patent
Thoma

(10) Patent No.: US 7,587,304 B2
(45) Date of Patent: Sep. 8, 2009

(54) PRINTING PRESS SIMULATOR

(75) Inventor: August Thoma, Bonstetten (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 149 days.

(21) Appl. No.: 11/397,515

(22) Filed: Apr. 4, 2006

(65) Prior Publication Data

US 2006/0219119 A1 Oct. 5, 2006

(30) Foreign Application Priority Data

Apr. 5, 2005 (DE) ..... 10 2005 015 506

(51) Int. Cl.
*G06G 7/48* (2006.01)

(52) U.S. Cl. ..... 703/7; 700/128

(58) Field of Classification Search ..... 703/6, 703/7, 13, 22; 430/18, 45.2, 47.5, 97, 126.1
See application file for complete search history.

(56) References Cited

U.S. PATENT DOCUMENTS

| | | | | |
|---|---|---|---|---|
| 4,223,453 | A | 9/1980 | Meyer | |
| 4,639,881 | A * | 1/1987 | Zingher | 715/839 |
| 5,121,467 | A * | 6/1992 | Skeirik | 706/10 |
| 5,434,961 | A * | 7/1995 | Horiuchi et al. | 715/507 |
| 5,551,011 | A * | 8/1996 | Danby et al. | 703/6 |
| 6,261,235 | B1 * | 7/2001 | Amano et al. | 600/485 |
| 6,522,422 | B1 * | 2/2003 | Klingler et al. | 358/1.15 |
| 6,705,229 | B2 | 3/2004 | Frankenberger | |
| 6,778,947 | B1 * | 8/2004 | Danzler | 703/6 |
| 7,069,153 | B2 * | 6/2006 | Johnson | 702/28 |
| 7,305,400 | B2 * | 12/2007 | Keith, Jr. | 707/101 |
| 2001/0034592 | A1 | 10/2001 | Herman | |
| 2002/0002449 | A1 | 1/2002 | Hermn | |
| 2004/0117399 | A1 | 6/2004 | Dittmar et al. | |
| 2006/0037375 | A1 | 2/2006 | Betzmeier et al. | |

OTHER PUBLICATIONS

Fredrik Fällström, Stig Nordqvist, Björn Hedin and Vlad Ionesco; "Using a Simulator for Testing and Validating a Newspaper Production Decision Support System"; Proceedings of The Thirtieth Annual Hawwaii International Conference on System Sciences; ISBN 0-8186-7862-3/97; © 1997 IEEE.*

Doctoral thesis by Johan Stenberg; "Global Production Management in Newspaper Production and Distribution—Coordination of Products, Processes and Resources"; Department of Manufacturing Systems, Division of Graphic Arts Technology, The Royal Institute of Technology, Stockholm, Sweden; 1997.*

Patterson et al, "Simulation of JIT Performance in a Printing Shop", Proceedings of the 2002 Winter Simulation Conference, San Diego, California, Dec. 8-11, 2002.*

Search Report dated Jun. 17, 2005 issued for the corresponding German Application No. 10 2005 015 506.5.

Search Report dated Aug. 25, 2006 issued for corresponding Great Britain Application No. 0606782.1.

* cited by examiner

*Primary Examiner*—Paul L Rodriguez
*Assistant Examiner*—Mary C Jacob
(74) *Attorney, Agent, or Firm*—Cohen Pontani Lieberman & Pavane LLP

(57) ABSTRACT

A printing press simulator for a printing press includes a simulation unit, which simulates a printing process or the behavior of a printing press on the basis of input data specified for the simulation and generates output data for displaying the results. The simulation unit accesses, for the purpose of the simulation, a database, which contains real printing press data recorded on the same model of printing press.

19 Claims, 1 Drawing Sheet

PRINTING PRESS SIMULATOR

BACKGROUND OF THE INVENTION

1. Field of the Invention

The invention pertains to a printing press simulator with a simulation unit which simulates a printing process on the basis of input data specified for the simulation and generates output data for displaying the result.

2. Description of the Related Art

Printing press simulators are known from the state of the art. With their help, it is possible to simulate the behavior of printing presses. A printing press simulator of this type is described in, for example, US 2001/0034592 A1. These types of printing press simulators are disconnected from the printing machine and designed as completely autonomous devices. The printing press simulators known from the state of the art operate on the basis of previously prepared default data, which are essentially the same for all types of printing presses, which means that they are not tailored to the configuration of a specific printing press. Therefore, these printing press simulators known from the state of the art cannot be used to train operators how to use a specific printing press configuration or to run diagnostic procedures on a specific configuration.

SUMMARY OF THE INVENTION

According to the invention, the simulation unit accesses a database for the purpose of the simulation. The database contains real printing press data recorded on the same model of printing press.

In accordance with the goal of the present invention, it is proposed that, for the purpose of the simulation, the printing press simulator access exclusively a database containing, as its entries, real printing press data recorded on the same model of printing press. The inventive printing press simulator therefore operates on the basis of real printing press data, which have been acquired previously on the same model of printing press. The inventive printing press simulator does not construct a model of the printing press to be simulated on the basis of complex system-dynamic or system-theoretical models. Instead, the simulation results are determined from the database, which contains, as its entries, real printing press data recorded on the same model of printing press. As a result, the printing press simulator has a much simpler design.

The inventive printing press simulator makes it possible to conduct individualized training programs, which are based on the printing press configuration acquired by the customer. This makes it possible to conduct more effective training than is possible with the printing press simulator known from the state of the art. The inventive printing press simulator is integrated into the control station of the printing press acquired by the customer, so that the training is carried out at the actual control station and not at a simulator bearing no resemblance to reality. This, too, leads to more effective training.

The database comprises printing press data which have been recorded on the same model of printing press during the production of real printed products. For this purpose, the printing parameters used on the same model of printing press during production and the print results achieved by the use of these printing parameters are recorded in a synchronized manner. The database therefore contains print results for a large number of printing parameters, namely, the results which were obtained by the use of these printing parameters on the same model of printing press.

To run a simulation, a printer specifies printing parameters as input data for the simulation unit. The simulation unit then accesses the database on the basis of these specified printing parameters and obtains the print results which were obtained during production on the same model of printing press by the use of identical printing parameters. The simulation unit makes these print results available as the simulation output, so that the output data can be dispayed.

An exemplary embodiment of the invention, which is not to be considered limiting in any way, is explained in greater detail below on the basis of the drawing.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
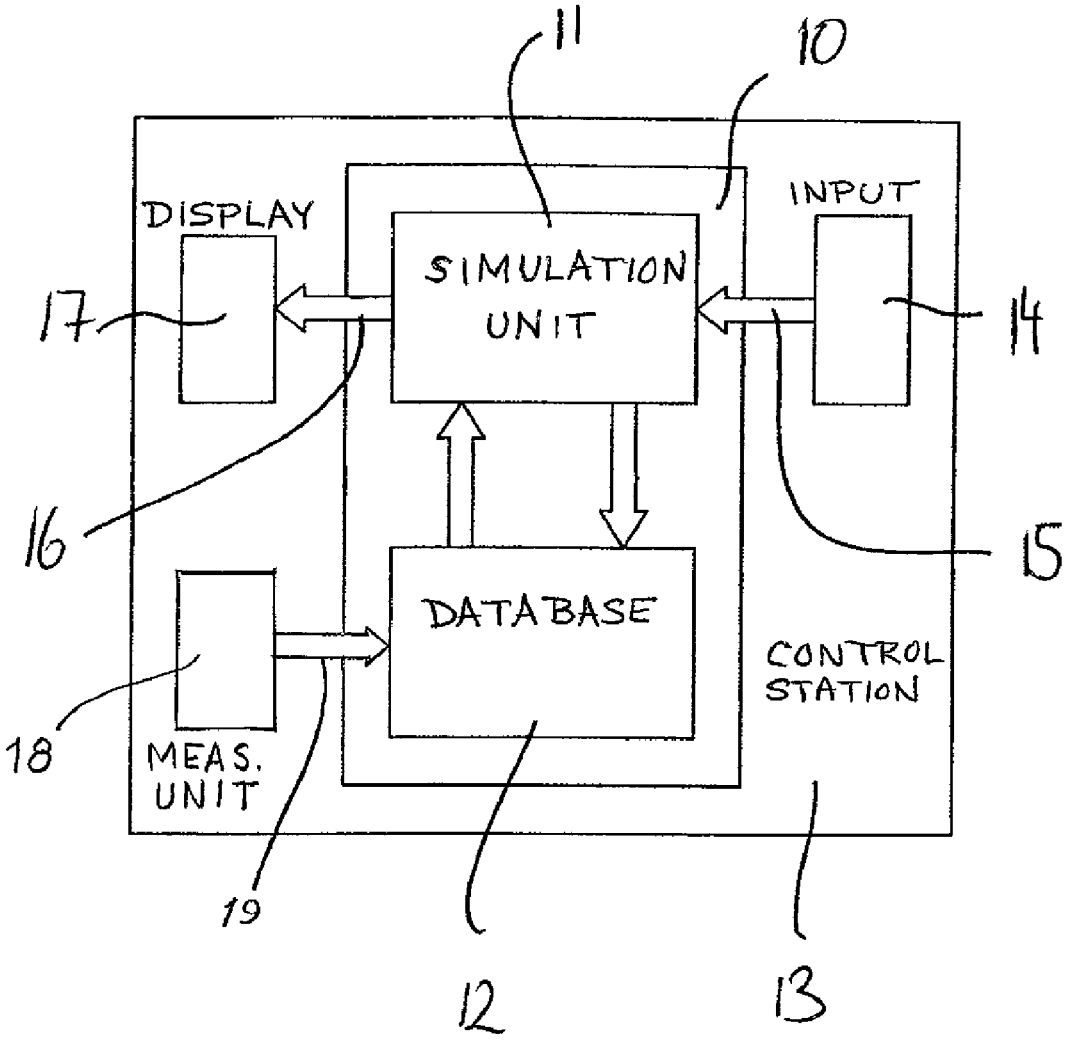
FIG. 1 shows a functional block diagram of an inventive printing press simulator.

FIG. 1 shows a functional block diagram of an inventive printing press simulator 10, which comprises a simulation unit 11 and a database 12. The printing press simulator 10 is preferably integrated into a control station 13 of the printing press acquired by a customer. Alternatively, the printing press simulator can be integrated into a control station of the same type without the presence of a printing press. A printer can use the input devices 14 of the control station 13 to enter input data 15 or printing parameters for the simulation, on the basis of which the printing press simulator 10, namely, the simulation unit 11 of the simulator, generates output data 16 as the result of the simulation. The output data 16 can be displayed visualized on display devices 17 of the control station 13. Because the printing press simulator 10 is integrated into the control station 13 of the printing press acquired by the customer or into a control station of the same type, employees can be trained in realistic manner.

In accordance with the present invention, the inventive printing press simulator 10, namely, the simulation unit 11, accesses the database 12 for the purpose of the simulation, where the database 12 contains real printing press data, which were recorded previously on the same model of printing press. The database 12 thus contains printing press data which were recorded on the same model of printing press during the production or printing of real print products. For this purpose, the printing parameters of the print run are recorded during the operation of the same model of printing press, and at the same time the print results achieved by the use of these printing parameters are also recorded, both being accomplished in an automated and synchronized manner. The printing parameters which are recorded include, for example, machine parameters such as the settings of the color units, the web tension devices, and the registration devices of the printing press. In addition, process parameters such as type of printing paper or type of printing ink can also be recorded.

A permanent, in-line record, preferably by the use of cameras, is made of the print product obtained on the same model of printing press by the use of the printing parameters in question. The product is also measured using a measuring unit 18, and the corresponding measurement values 19 are recorded synchronously and stored as the print results. The database 12 of the printing press simulator 10 therefore contains not only the real printing parameters but also the real measurement results of the actual print products obtained on the same model of printing press by means of the printing parameters in question. As previously mentioned, the printing parameters and the measurement data are recorded synchronously, so that the database contains sets of unique correlations between the printing parameters and the measurements data or print product data.

During the simulation, an operator uses the input devices 14 of the control station 13 to enter or to generate input data 15 for the printing press simulator 10. These input data 15 consist of printing parameters such as machine parameters and process parameters.

These input data 15 are made available to the simulation unit 11 of the printing press simulator 10. The simulation unit 11 then accesses the database 12 on the basis of these input data 15, which the operator has specified, and finds the print result which was obtained by the use of identical printing parameters on the same model of printing press from the database 12. These data are read out from the database 12 and sent by the simulation unit 11 as output data 16 to the display devices 17 of the control station 13, so that the data can be displayed on the display devices.

It is therefore consistent with the idea of the invention that, during the simulation, input data 15, namely, printing parameters, are specified by an operator. The simulation unit 11 of the printing press simulator 10 searches the database 12 of the printing press simulator 10 on the basis of the specified input data 15 and identifies the print result which was obtained on the same model of printing press with the use of already recorded printing parameters corresponding to the input data 15. This database entry (print results) is then made available as output for display. This means that simulation results are not calculated on the basis of complicated system-dynamic or system-theoretical models. Instead, the simulation results are determined from a database 12, which contains, as its database entries, real printing press data which were recorded on the same model of printing press.

When input data 15 have been specified for the simulation for which corresponding print results are present in the database 12, the function of the printing press simulator 10 merely involves the searching of the database 12 for the corresponding database entry. When, however, for the simulation, printing parameters are specified as input data 15 for which no corresponding printing parameters are on file in the database 12, it is consistent with the idea of the invention that the simulation unit 11 can conduct an interpolation.

The interpolation is conducted between the print result values which were recorded on the same model of printing press with the recorded printing parameters which come the closest to the printing parameters specified as input data 15 for the simulation. Alternatively, an interpolation can be omitted, and the print result which was recorded on the same model of printing press with printing parameters which come the closest to the printing parameters specified for the simulation can be provided as a simulation result.

According to an elaboration of the present invention, the database 12 is continuously updated. For this purpose, the input parameters of the print run and the print results obtained with those input parameters can be recorded synchronously and automatically during the print run of the printing press. In this case, the printing press data recorded on the same model of printing press are then supplemented or updated by printing press data which are determined on the actual printing press of the customer during his own print runs. As a result, it is possible to adapt the printing press simulator continuously to the actual printing press configuration of a customer. Operating personnel can thus be provided with customized training, and problems which occur on the printing press can be dealt with promptly.

As previously mentioned, the printing press simulator can also be integrated into a control station without the presence of a printing press. This has the advantage that training can be carried out even before the printing press has been delivered.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A printing press simulator integrated into a control station of an operating printing press, the simulator comprising:

a database structure containing real printing press data recorded on another printing press which is the same model as the operating printing press, as well as printing press data recorded on the operating printing press; and a simulation unit which simulates a print process or the behavior of the operating printing press by accessing data in the database based on input data specified for the simulation, said unit generating output data for displaying the result.

2. The printing press simulator of claim 1 wherein the printing press data comprises printing parameters recorded during production and print results obtained using said parameters and recorded simultaneously, both on the operating press and the press which is the same model as said operating press.

3. The printing press simulator of claim 2 further comprising means for an operator to specify printing parameters as input data to the simulation unit, said simulation unit accessing the database based on the specified parameters, determining print results based on the printing parameters recorded during production, and including the determined print results in said output data.

4. The printing press simulator of claim 3 wherein, when recorded printing parameters identical to the specified printing parameters are available in the database, the simulation unit includes the recorded print results corresponding to the identical printing parameters in said output data.

5. The printing press simulator of claim 3 wherein, when recorded printing parameters identical to the specified printing parameters are not available in the database, the simulation unit determines the print results by interpolating between the recorded print results corresponding to recorded printing parameters which come closest to the specified printing parameters.

6. The printing press simulator of claim 3 wherein, when recorded printing parameters identical to the specified printing parameters are not available in the database, the simulation unit includes the recorded print results corresponding to recorded printing parameters which come closest to the specified printing parameters in said output data.

7. The printing press simulator of claim 1 wherein the database is continuously updated by synchronously recording printing parameters and corresponding printing results in an automated manner during operation of the printing press.

8. An operating printing press comprising:

an input unit for specifying input printing parameters;

a measuring unit for recording printing press results corresponding to said input printing parameters specified using said input printing parameters; and a printing press simulator comprising:

a database structure containing recorded input printing parameters and corresponding print results recorded during production on another printing press which is the same model as said operating printing press, as well as supplemental input printing parameters specified using said input unit and recorded during production, and supplemental print results obtained using said supplemental input parameters and recorded using said measuring unit;

a simulation unit which simulates a printing press by identifying recorded input printing parameters corresponding to input printing parameters specified for simulation using said input unit, identifying recorded print results corresponding to the recorded input parameters so identified, and generating simulated output data based on the recorded print results so identified; and a display unit which displays the simulated output data.

9. The operating printing press of claim 8 wherein, when recorded printing parameters identical to the specified printing parameters are available in the database, the simulation unit includes the recorded print results corresponding to the identical printing parameters in said output data.

10. The operating printing press of claim 8 wherein, when recorded printing parameters identical to the specified printing parameters are not available in the database, the simulation unit determines the print results by interpolating between the recorded print results corresponding to recorded printing parameters which come closest to the specified printing parameters.

11. The operating printing press of claim 8 wherein, when recorded printing parameters identical to the specified printing parameters are not available in the database, the simulation unit includes the recorded print results corresponding to recorded printing parameters which come closest to the specified printing parameters in said output data.

12. The operating printing press of claim 8 wherein the database is continuously updated by synchronously recording the printing parameters and the corresponding printing results in an automated manner during operation of the printing press.

13. The operating printing press of claim 8 wherein the supplemental input printing parameters and the supplemental print results adapt the database structure to the operating printing press.

14. An operating printing press comprising:

a) an input unit for specifying input printing parameters for operating said operating printing press;

b) a measuring unit for recording print results corresponding to said input printing parameters specified using said input unit in a way that the input parameters specified using said input unit and the print results obtained on said printing press with those input parameters and measured with said measuring unit are recorded synchronously and automatically during a print run on said operating printing press; and c) a printing press simulator, comprising:

c1) a database structure containing:

c11) recorded input printing parameters and corresponding print results recorded during real print production on another printing press which is the same model as said operating printing press, both recorded in a synchronized and automated manner; and c12) supplemental input printing parameters specified using said input unit of said operating printing press and recorded during real production on said operating printing press, and supplemental print results obtained using said supplemental input parameters on said operating printing press and recorded using said measuring unit, the supplemental input printing parameters and the supplemental print results continuously adapting the database structure to said operating printing press;

c2) a simulation unit which simulates a print press by identifying recorded input printing parameters corresponding to input printing parameters specified for simulation using said input unit, identifying recorded print press results corresponding to the recorded input printing parameters so identified, and generating simulated output data based on the recorded print press results so identified by merely searching of the database structure for corresponding database structure entries without calculations on the basis of system-dynamic or system-theoretical models; and c3) a display unit which displays the simulated output data.

15. The operating printing press of claim 14 wherein, when recorded input printing parameters identical to the specified printing parameters are available in the database, the simulation unit includes the recorded print results corresponding to the identical printing parameters in said output data.

16. The operating printing press of claim 14 wherein, when recorded input printing parameters identical to the specified printing parameters are not available in the database, the simulation unit determines the print results by interpolating between the recorded print results corresponding to recorded printing parameters which come closest to the specified printing parameters.

17. The operating printing press of claim 14 wherein, when recorded input printing parameters identical to the specified printing parameters are not available in the database, the simulation unit includes the recorded print results corresponding to recorded printing parameters which come closest to the specified printing parameters in said output data.

18. The operating printing press of claim 14 wherein the database is continuously updated by synchronously recording the printing parameters and the corresponding printing results in an automated manner during operation of the printing press.

19. The operating printing press of claim 14 wherein the supplemental input printing parameters and the supplemental print results adapt the database structure to the operating printing press.

* * * * *